US005865347A

United States Patent [19]

Welschoff

[11] Patent Number: 5,865,347

[45] Date of Patent: Feb. 2, 1999

[54] MULTI-CHAMBER DISPENSER FOR FLOWABLE MATERIALS

[75] Inventor: Heinz Welschoff, Ft. Lauderdale, Fla.

[73] Assignee: William T. Wilkinson, Salem, N.J.

[21] Appl. No.: 958,517

[22] Filed: Oct. 27, 1997

[51] Int. Cl.[6] ..... B67D 5/52

[52] U.S. Cl. ..... 222/137; 222/326

[58] Field of Search ..... 222/137, 326, 222/485, 319, 320, 405, 386, 387

[56] References Cited

U.S. PATENT DOCUMENTS 2,826,339 3/1958 Maillard ..... 222/137

5,139,171 8/1992 Mader ..... 222/326

5,289,949 3/1994 Gentile ..... 222/137

5,645,193 7/1997 Gentile et al. ..... 222/137

*Primary Examiner*—Philippe Derakshani

*Attorney, Agent, or Firm*—Connolly & Hutz

[57] ABSTRACT

A multi-chamber dispenser for flowable materials includes a cartridge having a plurality of chambers disposed in side by side relationship. A pump has a plurality of longitudinal passageways corresponding to the number of chambers with each passageway being insertable into a chamber. The pump and cartridge are provided with guide structure to assure the proper positioning of the components and to permit the pump and cartridge to be readily mounted together and to be disassembled so that the pump may be used with a different cartridge after the contents have been dispensed.

21 Claims, 5 Drawing Sheets

MULTI-CHAMBER DISPENSER FOR FLOWABLE MATERIALS

BACKGROUND OF THE INVENTION

Various types of dispensers exist for flowable materials such as toothpaste and cosmetic materials, including creams and lotions. Other flowable materials may be food items such as mustard or ketchup. One advantageous form of such dispenser is a rigid pump wherein the materials are dispensed by telescopic movement of one component into the other. Variations of such pumps have included dual-chamber dispensers. Generally, however, poor use is made of the space as a result of the manner in which the chambers are arranged with respect to each other. A further disadvantage with such known dispensers is that the entire dispenser must generally be discarded when the contents have been fully dispensed.

SUMMARY OF THE INVENTION

An object of this invention is to provide a multi-chamber dispenser for flowable materials of the pump type.

A further object of this invention is to provide such a dispenser which utilizes a single use disposable cartridge containing the material and a reusable pump.

In accordance with this invention an upstanding disposable cartridge made of a rigid material includes a plurality of flowable material containing chambers disposed in side by side relationship. The dispenser also includes a rigid reusable pump having a plurality of longitudinal passageways with each passageway disposed for fluid communication with a respective chamber. Guide structure on the pump and cartridge telescopically receive the cartridge in the pump so that a sealing head around each passageway would make sealing contact with the walls of each chamber during telescopic movement of the pump and cartridge thereby forcing the flowable material from the chamber simultaneously from all chambers through all passageways for simultaneous dispensing from a discharge spout or neck in a product distribution cover at the top of the pump. The guide structure assures the proper positioning of the passageways and chambers and also function as detachable mounting structure so that a cartridge can be readily detached from the pump after the materials have been dispensed and replaced with a new cartridge whereby the cartridges are single use cartridges but the pump is reusable. Preferably the guide structure is interleaved or interdigitated walls of the cartridge and pump.

In a preferred practice of this invention the side walls of the chambers are flat to maximize use of available space. The cartridge, preferably includes sealing structure over the top of each chamber which would be removed or punctured prior to any dispensing. The removal can take place manually by the user before assembling the cartridge and pump together or can take place by the inlet end of the cartridge penetrating the sealing structure upon assembly of the pump and cartridge.

THE DRAWINGS

DETAILED DESCRIPTION

The present invention relates to a multi-chamber dispenser for flowable materials. Although the materials can be the same in all of the chambers, it is preferred that there be some difference in the materials. Such materials, within the broad practice of this invention can be any flowable material. Examples of suitable materials are toothpaste or cosmetic materials such as lotions or creams. Other examples include food items such as mustard, ketchup, cooking oils, mayonnaise and sour cream. Where the materials are toothpaste, one chamber may include toothpaste of a color that differs from the other chambers or have differing ingredients. The materials are preferably dispensed in side by side relationship. The invention, however, can be practiced by mixing the materials prior to dispensing.

The invention utilizes pump type structure wherein a rigid cartridge and a rigid pump are telescopically secured together with the cartridge containing the flowable materials so as to be bottom heavy and thus provide stability to the dispenser. In the preferred practice of the invention the cartridge and pump are detachably mounted together so that the cartridge would be a single use cartridge while the pump could be reusable with other cartridges of similar structure.

The dispenser also includes a product distribution cover mounted on top of the pump with a cap mounted at the outlet of the product distribution cover. The various components may be snapped together for readily being assembled and for selective disassembly.

Figure 8:
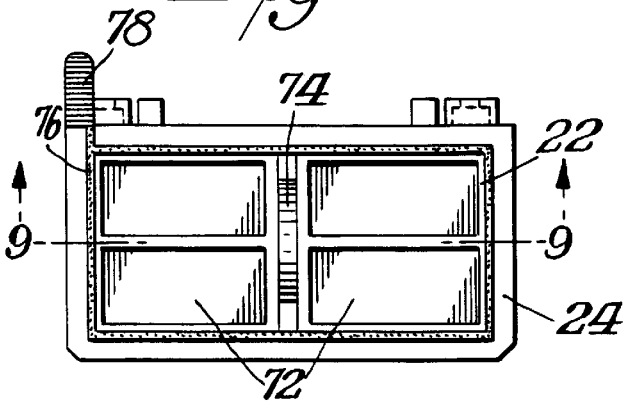
FIG. 8 is a top plan view of one form of cartridge which may be used in the dispenser of FIGS. 1–7.
Figure 9:
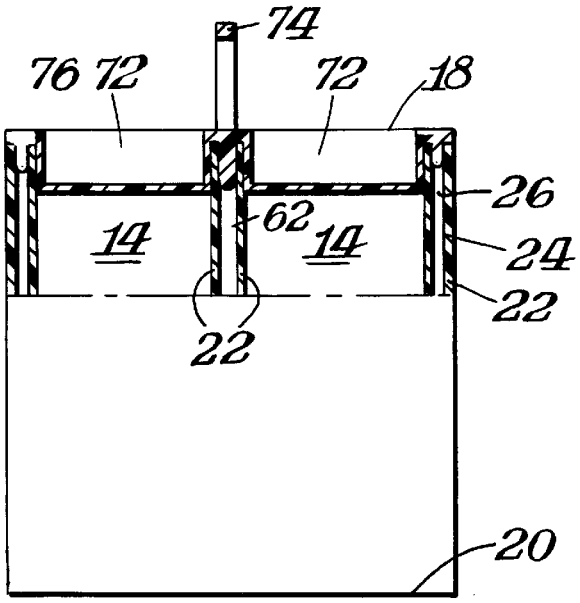
FIG. 9 is a cross-sectional view taken through FIG. 8 along the line 9—9.

FIGS. 1–7 illustrate a preferred practice of this invention. As shown therein the dispenser 10 includes an upstanding disposable cartridge 12 made of a rigid material such as molded ABS plastic. Cartridge 12 includes a plurality of supply chambers 14,14 which contain flowable material 16. The chambers are disposed in side by side relationship. As shown in FIG. 9, each chamber has a top 18, a closed bottom 20 and closed side walls 22. An outer wall 24 circumscribes all of the outwardly disposed walls 22 as shown in FIGS. 8–9. As a result there is a uniform spacing 26 between the walls 22 and 24. As later described the top 18 is closed by sealing structure so that prior to use the flowable material 16 is maintained in a sealed condition within each chamber 14 of the cartridge.

By having the side walls 22,22 of flat shape, maximum use is made of the space rather than having wasted space which would result from arcuate walls. Although the drawings illustrate two such chambers in device 10, a greater number of chambers may be used. Thus, for example, triangular chambers may be used where there are three chambers. Rectangular or square chambers may be used where there are four chambers, etc. The purpose of the flat sided chambers to avoid wasted space resulting from arcuate shaped chambers.

Figure 4:
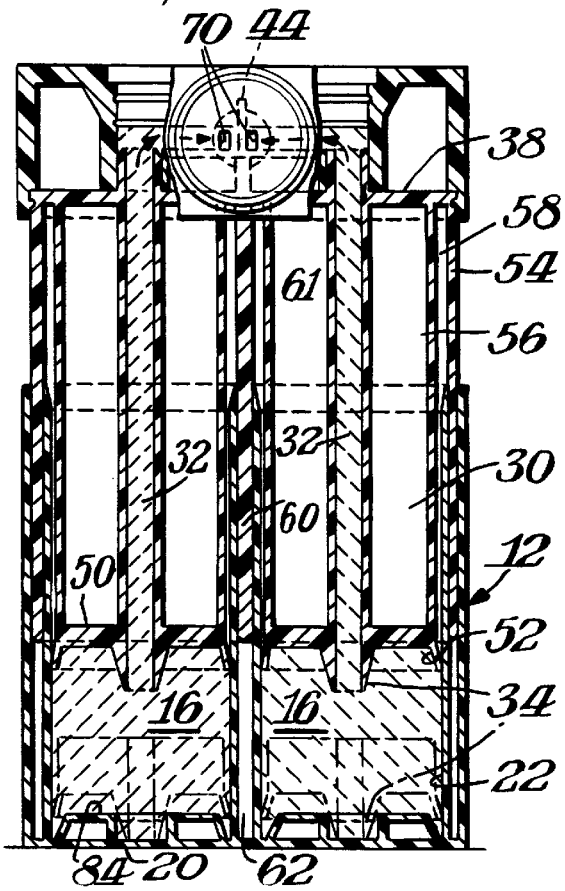
FIG. 4 is a front elevational view in section of the dispenser shown in FIGS. 1–3.
Figure 5:
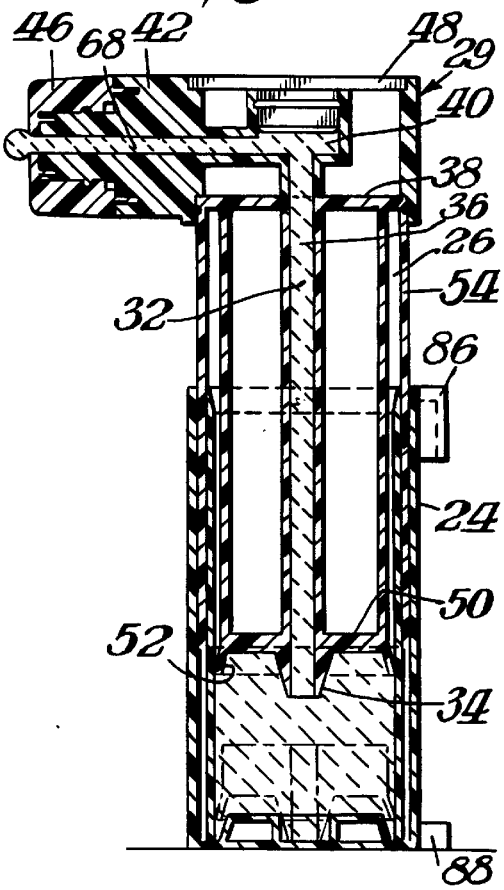
FIG. 5 is a right side elevational view in section of the dispenser shown in FIGS. 1–4.
Figure 7:
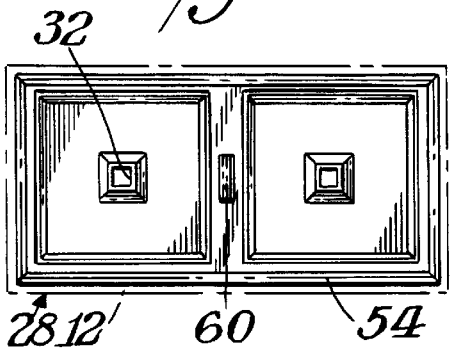
FIG. 7 is a bottom plan view of the pump used in the dispenser of FIGS. 1–6.

Device 10 also includes a rigid pump 28 with a product distribution cover 29 mounted to the top of the pump 28. Pump 28 includes a plurality of hollow sections 30 of a size and shape and number corresponding to the passageways 32. Thus, each chamber 14 has a corresponding section 30 of the pump mounted directly above the chamber 14. This permits the material 16 to be dispensed through a longitudinal passageway 32 located in each section 30. Preferably, although not necessarily, passageway 32 is located centrally in each section 30. Each passageway 32 is formed by walls 31 located in its hollow section 30. Passageway 32 has an upstream inlet end 34 and a downstream discharge end 36. Each of the passageways extends to an upper wall or partition 38 as shown in FIGS. 4–5. Product distribution cover 29 is mounted on top of pump 28. Product distribution cover 29 includes a passage 40 which is located for communicating with passageway 32. Passage 40, in turn, communicates with horizontal passage 68 extending through product distribution cover 29 for selective communication with an opening 70 in cap 46 as later described. Thus, a continuous path of flow is formed from the interior of chamber 14 through passageway 32 into passage 40 and then through passage 68 in neck 42 for ultimate discharge through opening 70. As later described the flowable materials 16 from all of the passageways are simultaneously dispensed through the neck 42 of cover 29. Preferably, the streams of material are distinct from each other as a result of a partition 44 in cover 29. See FIGS. 4 and 6.

Any suitable sanitary cap 46 may be mounted on neck 42. In the illustrated form cap 46 is rotatable 180° to either open or close communication of the neck 42 with holes 70. Preferably, access is had to the interior of cover 29 to permit cleaning, should such be necessary as a result of the repeated use of pump 28. Such access may be had by unsnapping cover 29 from pump 28. Cover 29 may contain a plug 48 which may contain a logo or some product identification of advertisement for the dispenser.

As shown in FIGS. 4–5, a pump head 50 is mounted around each passageway 32. Head 50 terminates in an outwardly and downwardly flared sealing rim 52 for making sealing engagement with the inner surface of walls 22. This is accomplished by shaping the head 50 and its peripheral sealing rim 52 of a complementary size and shape as the inner surfaces of inner walls 22 of each chamber 14.

A peripheral wall 54 extends around the walls 56 of each section 30 in pump 28. A spacing 58 is created which is of a size generally corresponding to the thickness of the inner walls 22 of chambers 14. Similarly, the thickness of outer wall 54 of pump 28 corresponds to the spacing 26 between walls 22 and 24 of cartridge 12. Pump 28 also includes a central wall or partition 60 located in the spacing 61 between adjacent sections 30. Wall 60 acts as a guide by fitting in the space 62 between the adjacent compartments 14,14. These walls and their spacing results in interleaved or interdigitated walls to function as guide structure to assure the proper positioning of cartridge 12 and pump 28 so that each passageway 32 is properly positioned with respect to each chamber 14. Additionally, this guide structure forms a detachable mounting, in cooperation with the sealing rim 52, to readily assemble the cartridge 12 and pump 28 together and also readily permit their disassembly. Thus, when the material 16 has been essentially completely dispensed from the chambers 14, cartridge 12 may be disassembled from pump 28. A new similar cartridge may then be assembled to pump 28 so that pump 28 is reusable thus avoiding the need to replace the pump whenever the contents have been expended from the cartridge.

Figure 3:
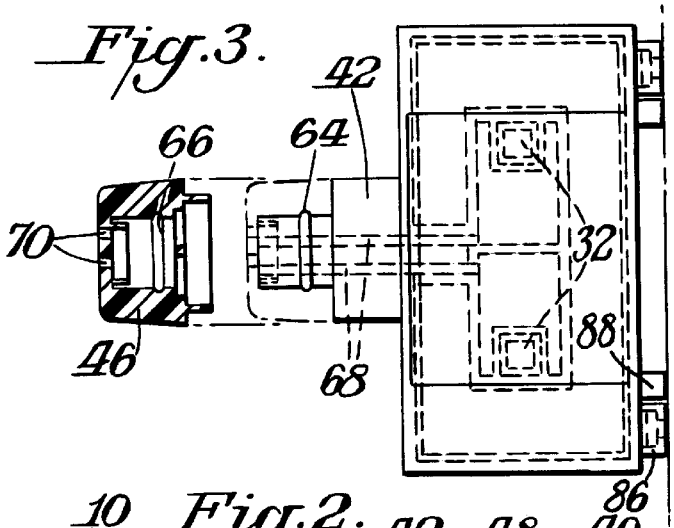
FIG. 3 is a top plan view partly in section of the dispenser shown in FIGS. 2–3.
Figure 1:
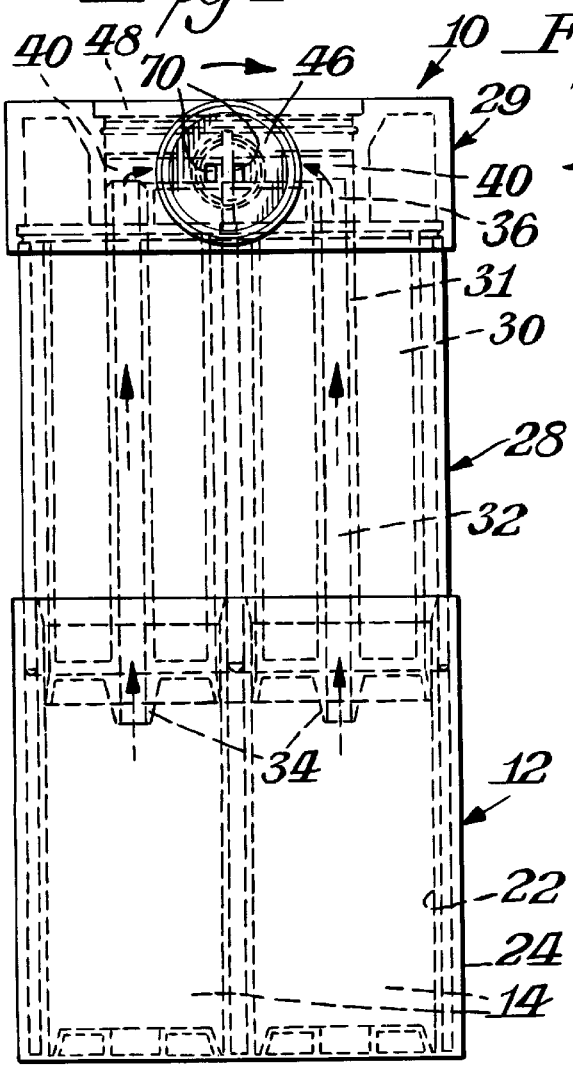
FIG. 1 is a front elevational view of a multi-chamber dispenser in accordance with this invention.
Figure 2:
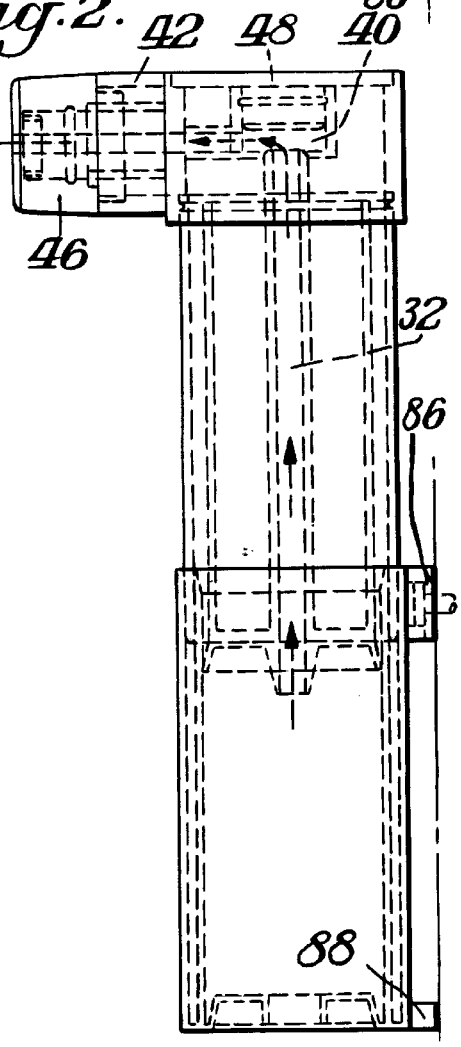
FIG. 2 is a right side elevational view of the dispenser shown in FIG. 1.
Figure 6:
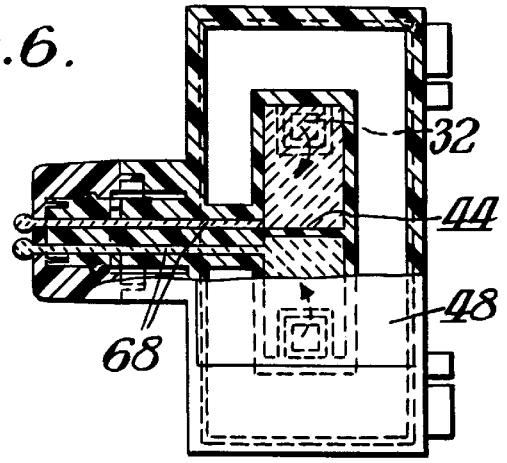
FIG. 6 is a top plan view partially broken away of the dispenser shown in FIGS. 1–5.

Pump 28 is preferably made of a rigid material such as ABS plastic. The various components are preferably individually molded and then snap fit together. Thus, for example, the upper portion of pump 28 could be snap fit to the lower portion of product distribution cover 29. Cap 46 could be snap fit on neck 42 as shown in FIG. 3. For example, neck 42 could contain an outer ring 64 which would be snap fit into a corresponding recess or groove 66 of cap 46. This would permit the cap 46 to be rotated while firmly held on the neck 42.

Figure 11:
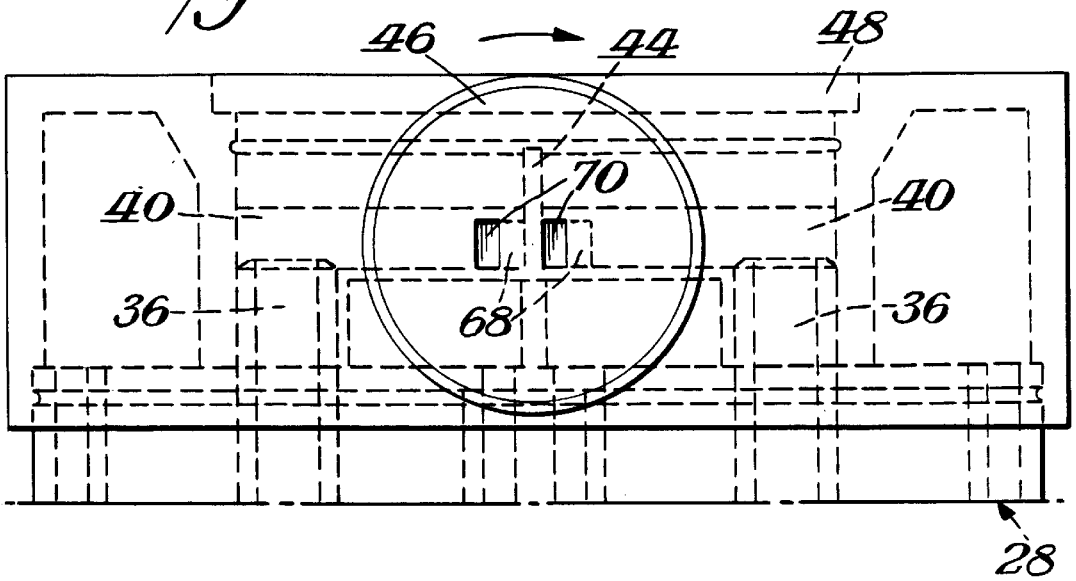
FIG. 11 is a fragmental front elevational view showing the dispenser of FIGS. 1–6 in the closed condition.
Figure 12:
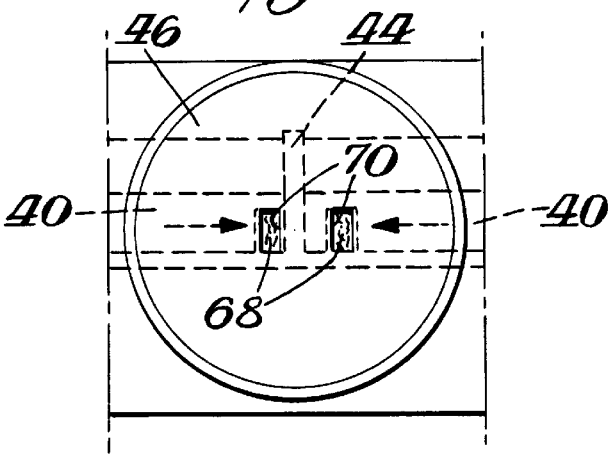
FIG. 12 is a view similar to FIG. 11 showing the dispenser in the open condition.

As illustrated neck 42 includes a plurality of individual passages 68 for selective alignment with dispensing openings 70 in cap 46. As shown in FIGS. 11–12, the passageways 68 are non-symmetrically spaced in that one of the passageways is closer to the central partition 44 than the other passageway. Similarly, dispensing openings 70 are spaced apart in the same manner. Thus, cap 46 can be rotated until the openings 70 are aligned with the passages 68 as shown in FIG. 12. This would permit materials 16 to be dispensed through each passageway. When sufficient material has been dispensed cap 46 is rotated 180° and the passages 68 and outlet openings 70 would be disposed out of alignment to close off the passages 68 as shown in FIG. 11.

Because cartridge 12 is intended to be replaceably mounted to pump 28, each chamber should be sealed to assure maintaining sanitary conditions for the materials 16 within the cartridge 12. Any suitable detachable sealing structure could be used. A simple form would be to have a sheet or film mounted across the top of cartridge 12 in contact with each top 18 of chamber 22 and then simply remove the entire sheet or film.

FIGS. 8–9 illustrate one manner of sealing the chambers 14,14 in cartridge 12. As shown therein each chamber is provided with a sealing plug 72 which fits into the top 18 of chamber 14. The plugs are interconnected by a pull ring 74 which extends downwardly into space 62. The outer edges of each plug is secured to the outer walls 22, 24 of chambers 14 by a tear strip or safety seal 76 having a pull tab 78. Tear strip 76 extends into space 26 thereby peripherally sealing the chambers 14,14. When it is intended to mount the cartridge to a pump, tab 78 is pulled to remove tear strip 76 thus releasing the outer edges of the plugs 72 from physical engagement with the outer walls of chambers 14. Ring 74 is then pulled outwardly thereby simultaneously removing all of the plugs 72 from the chambers 14 to expose the top 18 of each chamber 14. The cartridge 12 and pump 28 are then telescopically mounted together as previously described.

Figure 10:
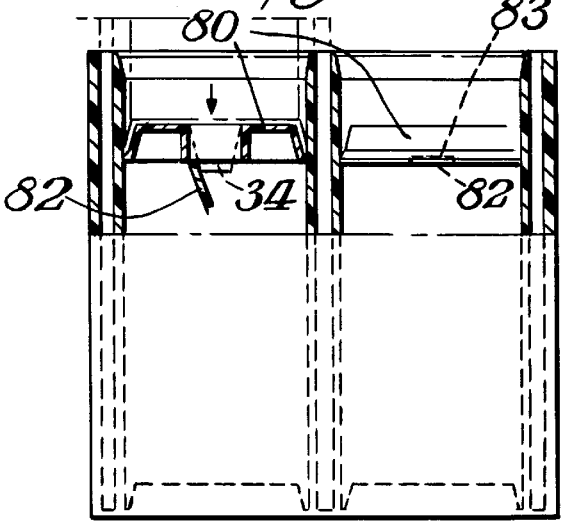
FIG. 10 is a front elevational view partly in section of an alternative form of seals inside the same type cartridge in accordance with this invention.

FIG. 10 illustrates an alternative manner of sealing separately each chamber 14. As shown therein a single plug-like sealing closure 80 is pushed into the otherwise open top 18 of chamber 14. The central portion of sealing closure 80 is provided with a flap which may result from having a weakened breakaway portion such as by weakened line or score lines 83 located in the general area of inlet end 34 of passageway 32. The top wall of closure 80 may have an open area corresponding to the size and shape of inlet end 34 so that end 34 passages readily breaks the connection of flap 82 when pump 28 and cartridge 12 are mounted together. During assembly of cartridge 12 and pump 28 the downwardly and inwardly tapered outer surface of inlet end 34 acts as a punch to penetrate closure 80 and push flap 82 open as shown in the left hand portion of FIG. 10. In use, as pump 28 is moved lower into cartridge 12 the closures 80 are also moved downwardly. The provision of sealing closures which remain in the cartridge (such as in FIG. 10) distinguish from closures or plugs which are removed from the cartridge as in FIGS. 8–9. The embodiment of FIG. 10 is desirable for products which might have a tendency to stick to the closure. Thus, where the closure or plug is completely removed as in FIGS. 8–9 some of the product or material 16 might be removed with the closure. With the arrangement of FIG. 10, however, by having a closure 80 remain in each chamber, such removal of material is avoided.

Reference is again made to FIGS. 4–5 which illustrates the relative position of various components during the course of dispensing. FIGS. 4–5 show in solid lines the components in an intermediate stage of dispensing. As shown therein pump 28 has been telescoped into cartridge 12 at a point in time where about half of the contents or material 16 has been dispensed. The upper portions of walls 22 are in spacings 58, 61. Walls 54 is in space 26. Wall 60 is in open area or space 62. FIGS. 4–5 shown in phantom the conditions when there has been a substantially complete dispensing of material 16. As shown therein tapered inlet end 34 penetrates an open central portion of base wall 84. Base wall 84 is tapered at its outer periphery to accommodate the sealing rim 52 which slightly enters the spacing between the side walls 22 and space wall 24. The user knows there has been complete dispensing when the outer edge of inlet end 34 contacts bottom wall 20 and can no longer move downwardly.

Dispenser 10 may be generally placed on a counter top or other surface during periods of use and non-use. If desired, however, particularly for bathroom use where space is sometimes at a premium, dispenser 10 may include some mounting structure to permit it to be mounted to a wall. Such mounting structure could be a hook or bracket 86 mounted to outer wall 24 at a location directly opposite spout 42. Hook or bracket 86 would detachably engage complementary structure on the walls. Hook or bracket 86 is preferably mounted at the top of cartridge 12. In order to maintain uniform spacing of the device 10 from the wall, one or more spacers 88 may be provided at the lower portion of wall 24.

Figure 14:
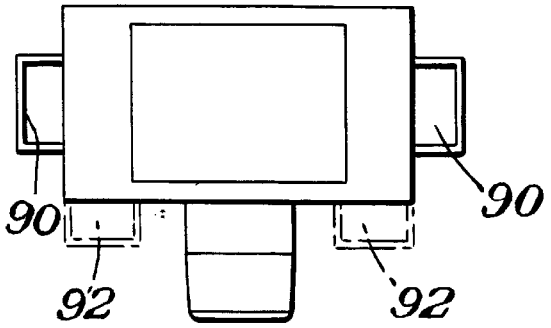
FIG. 14 is a top plan view of the dispenser shown in FIG. 14.
Figure 13:
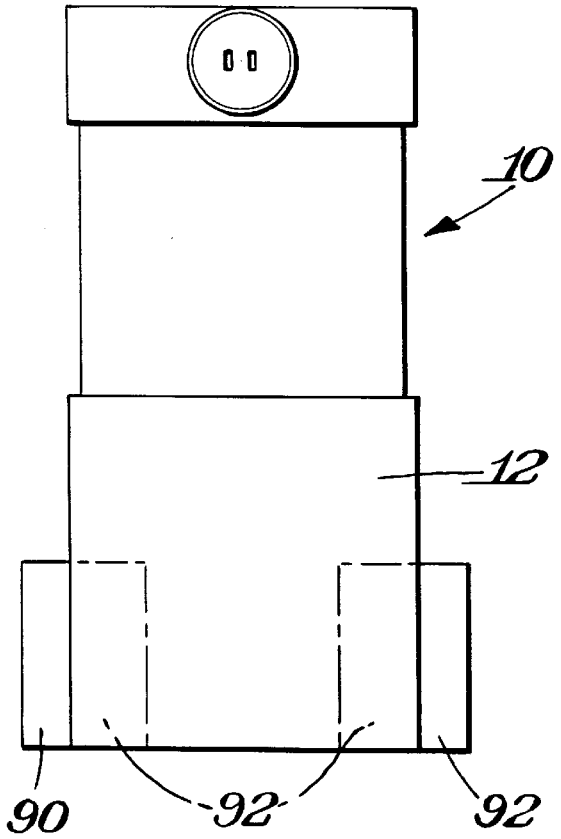
FIG. 13 is a front elevational view of a modified form of dispenser in accordance with this invention incorporating toothbrush holders.
Figure 15:
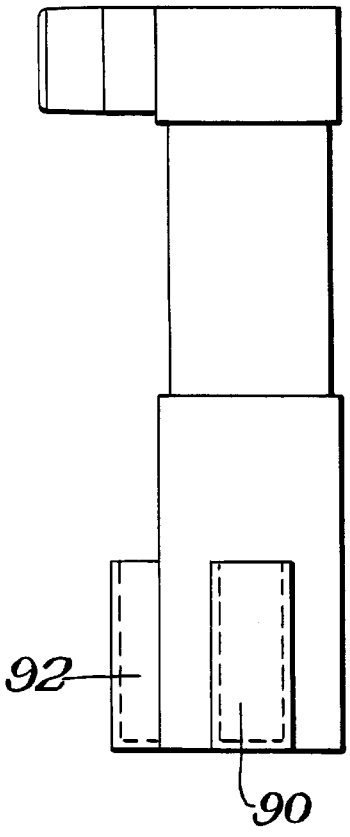
FIG. 15 is a right side elevational view of the dispenser shown in FIGS. 13–14.

FIGS. 13–15 illustrate optional features of the invention which are particularly desirable where dispenser 10 is used for toothpaste. As shown therein, any suitable number of toothbrush holders 90 can be secured to the outer surface of dispenser 10. Preferably, the toothbrush holders would be mounted to the cartridge 12. FIGS. 13–14, for example, illustrate in solid lines a toothbrush holder 90 mounted on each side of cartridge 12. Additional holders 92 are shown in phantom at the front of cartridge 12. Holders 92 may be provided in addition to or instead of holders 90. FIG. 15 thus illustrates in solid the combination of holders 90,92. Holders 90,92 may take any suitable form and preferably are of box like construction with an open top of a size and shape suitable for receiving a single toothbrush. If desired, other sizes and shapes could be used for receiving multiple toothbrushes in each holder. Thus, for example, instead of having each holder of box like construction a bracket may be provided, particularly at the top of cartridge 12 or secured to distribution cover 29 with the bracket having slots into which toothbrushes may be placed.

As can be appreciated dispenser 10 thus provides the advantages of being able to reuse the pump portion of the dispenser and replace the material containing portion or cartridge after the materials have been dispensed. The pump and cartridge are readily assembled in an effective manner to assure efficient dispensing action by simultaneously dispensing material from all of the chambers. Such mounting of the pump and cartridge, however, permits the readily disassembly of the pump and cartridge so that a used cartridge may be removed and replaced by a new cartridge.

What is claimed is:

1. A multi-chamber dispenser for flowable materials comprising an upstanding disposable cartridge made of a rigid material, a plurality of flowable material supply chambers in said cartridge, said supply chambers being disposed in side by side relationship, each of said supply chambers having a top and having a closed bottom and closed side walls, a rigid reusable pump, said pump having a plurality of longitudinal passageways corresponding to the number of said supply chambers, said pump being of a size and shape to fit around and over said chambers, guide structure on said pump and said cartridge for telescopically receiving said cartridge in said pump, a head around each of said passageways of a size and shape to slide into a respective one of said chambers in sealing contact with said walls of said chamber, said passageway having an upstream inlet end positioned for extending into said chamber whereby relative downward movement of said pump causes the flowable material to simultaneously enter all of the said passageways from all of said chambers, each of said passageway having a downstream discharge end, said pump having a dispensing neck, said discharge ends of all of said passageways communicating with said dispensing neck for simultaneously dispensing the flowable materials from all of said chambers, detachable sealing structure covering said top of each of said chambers to maintain the flowable material in a sealed condition prior to use of said dispenser, and said guide structure also being part of detachable mounting structure for detachably mounting said cartridge and said pump together whereby said cartridge may be removed from said pump when its flowable materials have been dispensed and a further cartridge may be then mounted to said pump to permit said pump to be reused.

2. The dispenser of claim 1 wherein said side walls of each of said chambers are flat.

3. The dispenser of claim 2 wherein said guide structure comprises a plurality of interleaved walls including a single outer peripheral wall on said pump, a single outer peripheral wall on said cartridge around said side walls of said chambers to create a space therebetween, and said single peripheral wall of said pump being mountable in said space.

4. The device of claim 3 wherein said pump includes a plurality of sections each of which contains one of said passageways, said guide structure further including an outer wall around each of said sections disposed inwardly of said single peripheral wall of said pump to create a spacing therebetween, a further spacing between adjacent sections, and said chamber walls of said cartridge being telescopically mounted in said spacings.

5. The device of claim 4 wherein said guide structure further includes a central guide wall in said pump located in said further spacing between said sections, said chambers having an open area therebetween, and said central guide wall being telescopically mounted in said open area between said chambers.

6. The device of claim 5 wherein said head includes an outwardly and downwardly flared sealing rim peripherally mounted around said head for slidable contact with the inner surfaces of said side walls.

7. The device of claim 1 including a product distribution cover mounted to the top of said pump, said dispensing neck being part of said product distribution cover, said product distribution cover including a set of passages each of which communicates with a respective one of said passageways, and said passages extending through said neck.

8. The device of claim 7 including a cap rotationally mounted on said neck, said cap having a plurality of dispensing openings corresponding to the number of said passages in said neck, and said rotational mounting selectively opening and closing communication of said openings and said passages.

9. The device of claim 1 wherein said inlet end of said passageway extends into said chamber downwardly beyond said head.

10. The device of claim 9 wherein said sealing structure comprises a sealing closure, the outer surface of said inlet end of said passageway being inwardly and downwardly tapered to comprise a punch for penetrating said sealing structure.

11. The device of claim 10 wherein said sealing structure includes a flap having breakaway structure to facilitate said punch penetrating said sealing structure, and each of said sealing closures being slidable downwardly in its said chamber.

12. The device of claim 1 wherein said sealing structure comprises a sealing plug in said top of each of said chambers, and said sealing plugs being detachably maintained in each of said chambers.

13. The device of claim 12 wherein said sealing plugs are connected to each other by a pull ring extending into said open area, and said sealing plugs being connected to said chambers by a peripheral tear strip extending into said space whereby said sealing plugs may be simultaneously removed from said cartridge by pulling said ring after said tear strip has been removed.

14. The device of claim 1 wherein each of said chambers has a square cross-sectional shape.

15. The device of claim 1 including wall mounting structure on said cartridge.

16. The device of claim 1 wherein said guide structure comprises a single outer peripheral wall on said pump, a single outer peripheral wall on said cartridge around said side walls of said chambers to create a space therebetween, and said single peripheral wall of said pump being mountable in said space.

17. The device of claim 16 wherein said pump includes a plurality of sections each of which contains one of said passageways, said guide structure further including an outer wall around each of said sections disposed inwardly of said single peripheral wall to create a space therebetween, and said single outer wall of said cartridge being telescopically mounted in said spacing.

18. The device of claim 17 wherein said guide structure further includes a central guide wall in said pump located in said further spacing said sections, said chambers having an open area therebetween, and said central guide wall being telescopically mounted in said open area between said chambers.

19. The device of claim 2 wherein each of said chambers has a square cross-sectional shape.

20. The device of claim 1 wherein said material is toothpaste, and including a plurality of toothbrush holders mounted externally to said device.

21. The device of claim 1 wherein said discharge end of each of said passageways communicates with a passage in said dispensing neck to comprise a plurality of said passages in said dispensing neck, said passages in said dispensing neck being non-symmetrically arranged with respect to each other, a cap mounted over said dispensing neck, said cap having a plurality of dispensing openings corresponding in number and location to said passages in said dispensing neck, and said cap being rotatably mounted on said dispensing neck for selectively disposing said openings in communication with said passages to permit the materials to be dispensed from said neck and selectively movable out of communication with said passages by rotation of said cap to prevent the dispensing of said materials.

* * * * *